US010329522B2

(12) United States Patent
Larson, III et al.

(10) Patent No.: US 10,329,522 B2
(45) Date of Patent: Jun. 25, 2019

(54) CLEANING COMPOSITIONS FOR USE WITH CALCITE-BASED STONE

(71) Applicant: Ecolab USA Inc., St. Paul, MN (US)

(72) Inventors: Dale Curtis Larson, III, Eagan, MN (US); Andrea Edward Hafez Kanani, Blaine, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 15/600,013

(22) Filed: May 19, 2017

(65) Prior Publication Data

US 2018/0002646 A1 Jan. 4, 2018

Related U.S. Application Data

(60) Provisional application No. 62/338,728, filed on May 19, 2016.

(51) Int. Cl.
*C11D 3/43* (2006.01)
*C11D 11/00* (2006.01)
(Continued)

(52) U.S. Cl.
CPC ..... *C11D 11/0052* (2013.01); *C11D 1/90* (2013.01); *C11D 3/044* (2013.01); *C11D 3/2082* (2013.01); *C11D 3/43* (2013.01)

(58) Field of Classification Search
CPC ..... C11D 11/0023; C11D 3/0094; C11D 3/43
(Continued)

(56) References Cited

U.S. PATENT DOCUMENTS 4,581,161 A 4/1986 Nedonchelle
5,254,290 A * 10/1993 Blandiaux ..... C11D 10/04 510/238
(Continued)

FOREIGN PATENT DOCUMENTS

CN 104497731 A 4/2015
EP 0 513 948 A2 11/1992
(Continued)

OTHER PUBLICATIONS

International Search Report and Written Opinion for Application No. PCT/US2017/033538 dated Jul. 27, 2017.
(Continued)

*Primary Examiner* — Gregory E Webb
(74) *Attorney, Agent, or Firm* — Merchant & Gould P.C.

(57) ABSTRACT

A composition for cleaning hard surfaces includes from 3 to 20 wt-% dicarboxylic acid; from 3 to 25 wt-% surfactant; from 0 to 20 wt-% solvent; and water, and has a pH from 9 to 12.5. A ready-to-use solution of the composition includes from 0.1 to 5 wt-% dicarboxylic acid; from 0.1 to 5 wt-% surfactant; from 0 to 5 wt-% solvent; and water, and has a pH from 9 to 12.5. The composition is safe for use with calcite stone surfaces. A method of cleaning calcite stone surfaces comprises a use solution of the composition to the calcite stone surface, and rinsing, wiping, or scrubbing the surface. Another method of cleaning calcite stone surfaces comprises preparing a use solution by diluting the composition with water, applying the use solution to the calcite stone surface, and rinsing, wiping, or scrubbing the surface.

38 Claims, 2 Drawing Sheets

(51) Int. Cl.
*C11D 3/04* (2006.01)
*C11D 3/20* (2006.01)
*C11D 1/90* (2006.01)

(58) Field of Classification Search
USPC ..... 510/238, 240, 362
See application file for complete search history.

(56) References Cited

U.S. PATENT DOCUMENTS

| | | | | |
|---|---|---|---|---|
| 5,472,629 | A | 12/1995 | Lysy et al. | |
| 5,538,760 | A | 7/1996 | Sharma | |
| 5,672,578 | A | 9/1997 | Carrie et al. | |
| 5,770,554 | A | 6/1998 | Misselyn et al. | |
| 5,962,388 | A | 10/1999 | Sherry et al. | |
| 5,965,514 | A | 10/1999 | Wierenga et al. | |
| 5,980,922 | A | 11/1999 | Mackey et al. | |
| 6,001,792 | A | 12/1999 | Vos | |
| 6,063,744 | A | 5/2000 | McQuillen | |
| 6,110,882 | A | 8/2000 | Evers | |
| 6,165,285 | A | 12/2000 | Evers et al. | |
| 6,277,805 | B1 | 8/2001 | Kupneski | |
| 6,342,473 | B1 * | 1/2002 | Kott | C11D 1/22 510/357 |
| 6,432,906 | B1 | 8/2002 | Carlson et al. | |
| 6,537,957 | B1 | 3/2003 | Cardola et al. | |
| 6,548,470 | B1 | 4/2003 | de Buzzaccarini et al. | |
| 6,583,103 | B1 | 6/2003 | Klinkhammer | |
| 6,699,828 | B1 | 3/2004 | de Buzzaccarini et al. | |
| 6,716,805 | B1 | 4/2004 | Sherry et al. | |
| 6,903,064 | B1 * | 6/2005 | Kasturi | C11D 3/0026 424/70.11 |
| 6,936,580 | B2 | 8/2005 | Sherry et al. | |
| 7,291,586 | B2 | 11/2007 | Boone et al. | |
| 7,470,656 | B2 | 12/2008 | Sherry et al. | |
| 7,507,699 | B2 | 3/2009 | Burt et al. | |
| 7,943,565 | B2 | 5/2011 | Kany et al. | |
| 8,188,025 | B2 | 5/2012 | Kany et al. | |
| 8,871,699 | B2 | 10/2014 | Silvernail et al. | |
| 9,150,492 | B2 | 10/2015 | Sharko et al. | |
| 2008/0139443 | A1 | 6/2008 | Buzinski et al. | |
| 2011/0036372 | A1 | 2/2011 | Stirling | |
| 2011/0146723 | A1 | 6/2011 | Reinhardt | |
| 2011/0271979 | A1 * | 11/2011 | Mondin | C11D 1/83 134/6 |
| 2012/0142577 | A1 | 6/2012 | Sun et al. | |
| 2013/0331308 | A1 | 12/2013 | Rees et al. | |
| 2014/0174480 | A1 * | 6/2014 | Larson, III | C11D 3/2086 134/26 |
| 2014/0235521 | A1 | 8/2014 | Silvernail et al. | |
| 2014/0290695 | A1 | 10/2014 | Uchiyama et al. | |
| 2015/0225674 | A1 | 8/2015 | Masters et al. | |
| 2017/0015946 | A1 * | 1/2017 | Dkidak | C11D 3/0026 |
| 2017/0145345 | A1 * | 5/2017 | Gonzales | C11D 17/0043 |

FOREIGN PATENT DOCUMENTS

| | | |
|---|---|---|
| GB | 1 528 171 | 10/1978 |
| JP | 57-83598 | 5/1982 |
| JP | 61-287990 | 12/1986 |
| JP | 3-190999 | 8/1991 |
| JP | 4-332799 | 11/1992 |
| JP | 4-332800 | 11/1992 |
| JP | 11-80784 | 3/1999 |
| JP | 2002-143788 | 5/2002 |
| JP | 2002-173698 | 6/2002 |
| JP | 2002-294281 | 10/2002 |
| JP | 2008-44993 | 2/2008 |
| KR | 10-1378002 B1 | 3/2014 |
| RU | 2 167 191 C1 | 5/2001 |
| SU | 250356 | 11/1968 |
| WO | 95/14070 | 5/1995 |
| WO | 97/04059 | 2/1997 |
| WO | 02/50225 A1 | 6/2002 |
| WO | 2013/064315 A1 | 5/2013 |
| WO | 2013/064340 A1 | 5/2013 |
| WO | 2014/179128 A1 | 11/2014 |
| WO | 2014/192680 A1 | 12/2014 |

OTHER PUBLICATIONS

Schmidt, W.W. et al., "A Novel Dianionic Surfactant from the Reaction of C14-Alkenylsuccinic Anhydride with Sodium Isethionate," JAOCS, vol. 71, No. 7, pp. 695-703 (Jul. 1994).

* cited by examiner

CLEANING COMPOSITIONS FOR USE WITH CALCITE-BASED STONE

CROSS-REFERENCE TO RELATED APPLICATION

This application claims the benefit of U.S. Provisional Application No. 62/338,728, filed May 19, 2016, and is hereby incorporated by reference in its entirety.

FIELD

The present disclosure relates to cleaning compositions. In particular, the present disclosure relates to cleaning compositions that are compatible with calcite-based stone surfaces.

BACKGROUND

Calcite-based stones, such as marble, limestone (e.g., travertine), or onyx, can be used as surface materials and as flooring materials in bathrooms, kitchens, and buildings in general. However, such stones can be sensitive to cleaning compositions with acidic or strongly alkaline pH.

The sensitivity to acidic pH can be particularly problematic with bathroom surfaces, where acidic cleaners can be used to remove lime soap soils. Lime soap soils are colloquially called "soap scum" and are a reaction product of water hardness ions (calcium and magnesium) and fatty acids of soaps. Lime soap soils are generally known as challenging soils to remove, and can make the affected surface more difficult to clean and more susceptible to buildup of other soils and biofilm. Lime soap soils can be dissolved with acidic cleaners. However, acidic cleaners can damage calcite-based stone surfaces and are therefore not recommended for use with such surfaces. It is against this background that the present disclosure is made.

SUMMARY

The present disclosure relates to a composition and a method for cleaning hard surfaces with the composition. The composition comprises from 3 to 20 wt-% dicarboxylic acid; from 3 to 25 wt-% surfactant; from 0 to 20 wt-% solvent; and water, and has a pH from 9 to 12.5. A ready-to-use solution of the composition includes from 0.1 to 5 wt-% dicarboxylic acid; from 0.1 to 5 wt-% surfactant; from 0 to 5 wt-% solvent; and water, and has a pH from 9 to 12.5. The composition is safe for use with calcite stone surfaces. In one aspect, a method of cleaning calcite stone surfaces comprises a use solution of the composition to the calcite stone surface, and rinsing, wiping, or scrubbing the surface. In another aspect, the method comprises preparing a use solution by diluting the composition with water, applying the use solution to the calcite stone surface, and rinsing or wiping the surface.

DETAILED DESCRIPTION

Figure 1:
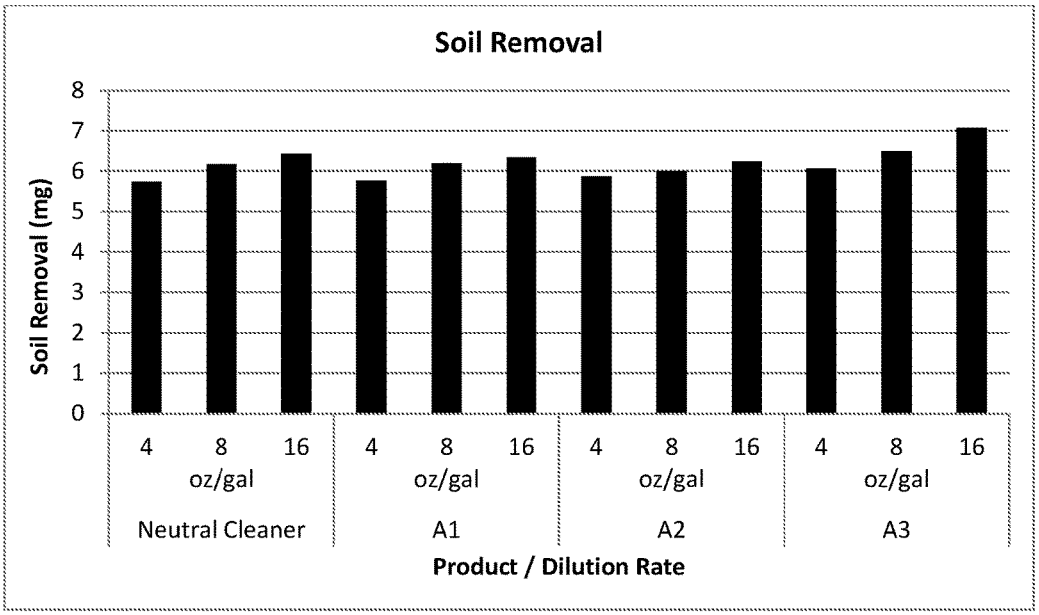
FIG. 1 is a graphical presentation of the results of Example 1.

The present disclosure relates to cleaning compositions that are compatible with sensitive stone surfaces, such as calcite-based stone surfaces. Calcite-based stones include, for example, marble, limestone, chalk, traventine, and onyx. Such stones are susceptible to damage by acidic compositions, which can erode the surface of the stone. Other surfaces, such as certain tiles, can also be sensitive to acidic compositions. Cleaning surfaces made from sensitive materials, such as calcium-containing (e.g., calcite-based) stones, can be challenging particularly in areas where lime soap based soils may have accumulated, such as in bathrooms and kitchens (e.g., showers, toilets, sinks, countertops, and surrounding areas). The present disclosure provides for a cleaning composition that is effective against lime soap-based soils and can be safely used on calcite-based stone and other surfaces.

The composition of the present disclosure can be formulated for use as a bathroom cleaner, a kitchen cleaner, a general purpose cleaner, or a floor cleaner. The composition of the present disclosure is formulated to be compatible with sensitive surfaces, such as calcite-based stone surfaces and tile surfaces.

The term "about" is used here in conjunction with numeric values to include normal variations in measurements as expected by persons skilled in the art, and is understood have the same meaning as "approximately" and to cover a typical margin of error, such as +5% of the stated value.

As used herein, "weight percent," "wt-%," "percent by weight," "% by weight," and variations thereof refer to the concentration of a substance as the weight of that substance in relation to the total weight of the composition. It is understood that, as used here, "percent," "%," and the like are intended to be synonymous with "weight percent," "wt -%," etc.

It should be noted that, as used in this specification and the appended claims, the singular forms "a," "an," and "the" include plural referents unless the content clearly dictates otherwise. Thus, for example, reference to a composition containing "a compound" includes a composition having two or more compounds. It should also be noted that the term "or" is generally employed in its sense including "and/or" unless the content clearly dictates otherwise.

The transitional phrase "consisting essentially of" as used in the claims limits the scope of the claim to the specified materials including only minor impurities or inactive agents that a person of ordinary skill in the relevant art would ordinarily associate with the listed components.

The composition of the present disclosure can be used to clean sensitive stone surfaces (e.g., calcite stone surfaces). Any suitable cleaning method can be used. For example, the composition can be applied onto the surface by spraying, misting, foaming, sponging, dripping, pouring, wiping, or any other suitable method. The composition may be a concentrate that is diluted prior to use, or a ready-to-use solution. The surface can be cleaned by wiping, sponging, brushing, scrubbing, or any other suitable method. The composition may be wiped or sponged off of the surface after cleaning, or the surface can be rinsed with water.

The composition may be provided as a concentrate or as a use solution. A concentrate composition may be diluted to form a use solution prior to use with a suitable diluent, such as water or another aqueous solution. The dilution ratio can be adjusted to result in a suitable strength use solution. For example, the dilution ratio can be from about 1:2 to about 1:100, or from about 1:4 to about 1:50, or from about 1:10 to about 1:30.

According to at least one embodiment, the composition comprises a dicarboxylic acid or its salt, one or more surfactants, and optional solvents and co-solvents. The composition has a pH in the range of 7-12.5, or preferably from about 10 to about 12. The composition may be provided as a concentrate that is diluted into a use solution prior to use. Alternatively, the composition can be provided as a ready-to-use formulation.

Dicarboxylic Acid or its Salt

The terms dicarboxylic acid and dicarboxylic acid salt are used here interchangeably, and the term dicarboxylic acid is used here collectively to indicate that the composition can include the acid and/or its salt.

The dicarboxylic acid can be selected from carboxylic acids having two carboxyl groups and a carbon chain length of 2 to 8, or from 3 to 6. For example, the dicarboxylic acid can be selected from malonic acid, succinic acid, glutaric acid, adipic acid, and combinations thereof. The dicarboxylic acid may also be an unsaturated or branched carboxylic acid. In some embodiments, the dicarboxylic acid does not include other functional groups in addition to the two carboxyl groups.

The dicarboxylic acid can be present at about 0.1 to about 5%, about 0.15 to about 4%, about 0.2 to about 3%, or about 0.3 to about 2.5% of a use solution of the composition. In one example, the dicarboxylic acid is present at about 0.25 to about 4% of the composition. If the composition is provided as a concentrate, the dicarboxylic acid can be present at about 3 to about 25%, about 4 to about 20%, or about 5 to about 15% of the composition.

Surfactants

The composition may include one or more surfactants. The surfactants can be selected from cationic, anionic, nonionic, amphoteric, and zwitterionic surfactants. Amphoteric surfactants are known for their ability to produce foam and for acting as hydrotropes. In some embodiments, the composition includes at least an amphoteric surfactant. Some nonionic surfactants, such as amine oxides, are known for good compatibility with quaternary ammonium compounds used as antimicrobials, and for their ability to assist in removal of lime soaps. In some embodiments, the composition includes a nonionic surfactant.

Cationic Surfactants.

The composition may comprise one or more cationic surfactants. A commonly used group of cationic surfactants is amines, such as alkylamines and amido amines. The amine group includes, for example, alkylamines (e.g., monoethanolamine "MEA", diethanolamine "DEA", or triethanolamine "TEA") and their salts, alkyl imidazolines, ethoxylated amines, and quaternary ammonium compounds and their salts. Other cationic surfactants include sulfur (sulfonium) and phosphorus (phosphonium) based compounds that are analogous to the amine compounds.

Surfactants are classified as cationic if the charge on the hydrotrope portion of the molecule is positive or surfactants in which the hydrotrope carries no charge unless the pH is lowered close to neutrality or lower, but which are then cationic (e.g. alkyl amines). In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds.

Cationic surfactants generally refer to compounds containing at least one long carbon chain hydrophobic group and at least one positively charged nitrogen. The long carbon chain group may be attached directly to the nitrogen atom by simple substitution; or indirectly by a bridging functional group or groups in so-called interrupted alkylamines and amido amines. Such functional groups can make the molecule more hydrophilic or more water dispersible, more easily water solubilized by co-surfactant mixtures, or water soluble. For increased water solubility, additional primary, secondary or tertiary amino groups can be introduced or the amino nitrogen can be quarternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn as:

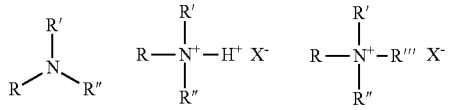

in which, R represents a long alkyl chain, R', R", and R'" may be either long alkyl chains or smaller alkyl or aryl groups or hydrogen and X represents an anion.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties including detergency in compositions of or below neutral pH, antimicrobial efficacy, thickening or gelling in cooperation with other agents, and the like.

Exemplary cationic surfactants include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

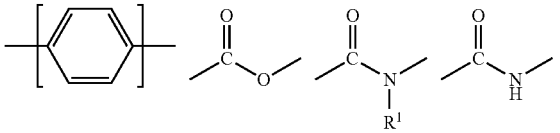

or an isomer or mixture of these structures, and which contains from 8 to 22 carbon atoms. The $R^1$ groups can additionally contain up to 12 ethoxy groups; m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group, such as one of the following:

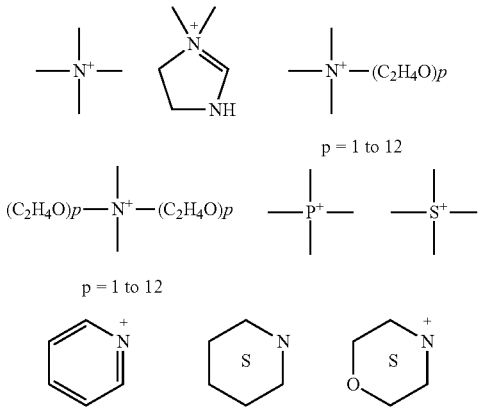

or a mixture thereof. Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Anionic Surfactants.

Anionic surfactants are useful as detersive surfactants, but also as gelling agents or as part of a gelling or thickening system, as solubilizers, and for hydrotropic effect and cloud point control. The composition may include one or more anionic surfactants. Suitable anionic surfactants for the present composition include: carboxylic acids and their salts, such as alkanoic acids and alkanoates, ester carboxylic acids (e.g. alkyl succinates), ether carboxylic acids, and the like; phosphoric acid esters and their salts; sulfonic acids and their salts, such as isethionates, alkylaryl sulfonates, alkyl sulfonates, sulfosuccinates; and sulfuric acid esters and their salts, such as alkyl ether sulfates, alkyl sulfates, and the like.

Anionic surfactants includes those with a negative charge on the hydrophobic group or surfactants in which the hydrophobic section of the molecule carries no charge unless pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility. The particular salts will be suitably selected depending upon the needs of the particular formulation.

Anionic surfactants are excellent detersive surfactants and typically have high foam profiles. Anionic surfactants can also be useful to impart special chemical or physical properties other than detergency within the composition. Anionics can be employed as gelling agents or as part of a gelling or thickening system. Anionics are also excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," *Cosmetics & Toiletries*, Vol. 104 (2) 71-86 (1989). The first class includes acylamino acids (and salts), such as acylglutamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Exemplary anionic surfactants include the following:

Linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein).

Ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants such as alkyl ethoxy carboxylates, the alkyl polyethoxy polycarboxylate surfactants and the soaps (e.g. alkyl carboxyls). Secondary soap surfactants (e.g. alkyl carboxyl surfactants) include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic surfactants include olefin sulfonates, such as long chain alkene sulfonates, long chain hydroxyalkane sulfonates or mixtures of alkenesulfonates and hydroxyalkane-sulfonates. Also included are alkyl sulfates, alkyl poly (ethyleneoxy) ether sulfates and aromatic poly(ethyleneoxy) sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

Nonionic Surfactants.

In some embodiments, the composition comprises a nonionic surfactant. Nonionic surfactants improve soil removal and can reduce the contact angle of the solution on the surface being treated.

Nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Examples of suitable nonionic surfactants include: block polyoxypropylene-polyoxyethylene polymeric compounds, including commercially available products PLURONIC® and TETRONIC® manufactured by BASF Corp. in Florham Park, N.J.; condensation products of alkyl phenol with ethylene oxide, including commercially available products IGEPAL® manufactured by Rhone-Poulenc and TRITON® manufactured by Union Carbide; condensation products of a straight or branched chain alcohol having from 6 to 24 carbon atoms with ethylene oxide, including commercially available products NEODOL® manufactured by Shell Chemical Co. and ALFONIC® manufactured by Vista Chemical Co.; condensation products of straight or branched chain carboxylic acid with ethylene oxide, including commercially available products NOPALCOL® manufactured by Henkel Corporation and LIPOPEG® manufactured by Lipo Chemicals, Inc.; alkanoic acid esters formed by reaction with glycerides, glycerin, and polyhydric alcohols; alkyl amine oxides, including commercially available BARLOX® and FMB® amine oxides, both available from Lonza Inc. in Allendale, N.J.

Alkoxylated (e.g., ethoxylated or propoxylated) $C_6$-$C_{18}$ fatty alcohols are suitable surfactants for use in the present compositions. An example of a suitable alkoxylated alcohol is ethoxylated C10 alcohol, commercially available as LUTENSOL XP® from BASF Corp., in Florham Park, N.J.

Exemplary nonionic surfactants further include the following:

Block polyoxypropylene-polyoxyethylene polymeric compounds based upon propylene glycol, ethylene glycol, glycerol, trimethylolpropane, and ethylenediamine as the initiator reactive hydrogen compound, such as: difunctional block copolymers (PLURONIC® products available from BASF Corp.); and tetra-functional block copolymers (TETRONIC® products available from BASF Corp.)

Condensation products of one mole of alkyl phenol wherein the alkyl chain, of straight chain or branched chain configuration, or of single or dual alkyl constituent, contains from about 8 to about 18 carbon atoms with from about 3 to about 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Commercially available examples include IGEPAL® available from Solvay S.A., and TRITON® available from the DOW Chemical Company.

Condensation products of one mole of a saturated or unsaturated, straight or branched chain alcohol having from about 6 to about 24 carbon atoms with from about 3 to about 50 moles of ethylene oxide. The alcohol moiety can consist of mixtures of alcohols in the above delineated carbon range or it can consist of an alcohol having a specific number of carbon atoms within this range. Commercially available examples include NEODOL® available from Shell Chemical Co. and ALFONIC® available from Sasol North America, Inc.

Condensation products of one mole of saturated or unsaturated, straight or branched chain carboxylic acid having from about 8 to about 18 carbon atoms with from about 6 to about 50 moles of ethylene oxide. The acid can be a mixture of acids in the above-defined carbon atoms range or it can be an acid having a specific number of carbon atoms within the range. Commercially available examples include LIPOPEG® available from Lipo Chemicals, Inc.

Alkanoic acid esters formed by reaction with glycerides, glycerin, and polyhydric (saccharide or sorbitan/sorbitol) alcohols. All of these ester moieties have one or more reactive hydrogen sites on their molecule which can undergo further acylation or ethylene oxide (alkoxide) addition to control the hydrophilicity of these substances.

In some embodiments the composition comprises low-foaming nonionic surfactants. Exemplary low-foaming nonionic surfactants include:

Reverse block copolymers which are block copolymers, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from about 1,000 to about 3,100 with the central hydrophile including 10% by weight to about 80% by weight of the final molecule. Also included are di-functional reverse block copolymers (commercially available as PLURONIC® R from BASF Corp.) and tetra-functional reverse block copolymers (commercially available as TETRONIC® R from BASF Corp.)

Capped nonionic surfactants which are modified by "capping" or "end blocking" the terminal hydroxy group or groups (of multifunctional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

The alkylphenoxypolyethoxyalkanols of U.S. Pat. No. 2,903,486 issued Sep. 8, 1959 to Brown et al. and represented by the formula:

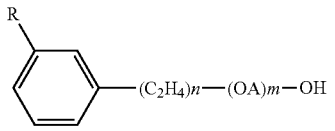

where R is an alkyl group of 8 to 9 carbon atoms; A is an alkylene chain of 3 to 4 carbon atoms; n is an integer of 7 to 16; and m is an integer of 1 to 10.

Polyalkylene glycol condensates described in U.S. Pat. No. 3,048,548 issued Aug. 7, 1962 to Martin et al., having alternating hydrophilic oxyethylene chains and hydrophobic oxypropylene chains where the weight of the terminal hydrophobic chains, the weight of the middle hydrophobic unit and the weight of the linking hydrophilic units each representing about one-third of the condensate.

Defoaming nonionic surfactants disclosed in U.S. Pat. No. 3,382,178 issued May 7, 1968 to Lissant et al. having the general formula $Z[(OR)_nOH]_z$, where Z is an alkoxylatable material; R is a radical derived from an alkaline oxide which can be ethylene and propylene; n is an integer from 10 to 2,000 or more; and z is an integer determined by the number of reactive oxyalkylatable groups.

Conjugated polyoxyalkylene compounds described in U.S. Pat. No. 2,677,700, issued May 4, 1954 to Jackson et al. corresponding to the formula $Y(C_3H_6O)_n(C_2H_4O)_mH$ where Y is the residue of organic compound having from about 1 to 6 carbon atoms and one reactive hydrogen atom; n is an average value of at least about 6.4, as determined by hydroxyl number; and m is a value such that the oxyethylene portion constitutes about 10% to about 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ where Y is the residue of an organic compound having from about 2 to 6 carbon atoms and containing x reactive hydrogen atoms where x has a value of at least about 2; n is a value such that the molecular weight of the polyoxypropylene hydrophobic base is at least about 900; and m is a value such that the oxyethylene content of the molecule is from about 10% to about 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents correspond to the formula: $P[(C_3H_6O)_n(C_2H_4O)_mH]_x$ where P is the residue of an organic compound having from about 8 to 18 carbon atoms and containing x reactive hydrogen atoms where x has a value of 1 or 2; n is a value such that the molecular weight of the polyoxyethylene portion is at least about 44; and m is a value such that the oxypropylene content of the molecule is from about 10% to about 90% by weight. In either case the oxypropylene chains may optionally contain small amounts of ethylene oxide and the oxyethylene chains may also optionally contain small amounts of propylene oxide.

Polyhydroxy fatty acid amide surfactants include those having the structural formula $R^2CONR^1Z$ where $R^1$ is H, $C_1$-$C_4$ hydrocarbyl, 2-hydroxy ethyl, 2-hydroxy propyl, ethoxy, propoxy group, or a mixture thereof; $R^2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

Alkyl ethoxylate condensation products of aliphatic alcohols with from about 0 to about 25 moles of ethylene oxide. The alkyl chain of the aliphatic alcohol can either be straight or branched, primary or secondary, and generally contains from 6 to 22 carbon atoms.

Ethoxylated $C_6$-$C_{18}$ fatty alcohols and $C_6$-$C_{18}$ mixed ethoxylated and propoxylated fatty alcohols. Suitable ethoxylated fatty alcohols include the $C_{10}$-$C_{18}$ ethoxylated fatty alcohols with a degree of ethoxylation of from 3 to 50.

Nonionic alkylpolysaccharide surfactants include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants include those having the formula $R^6CON(R^7)_2$ where $R^6$ is an alkyl group containing from 7 to 21 carbon atoms; and each $R^7$ is independently hydrogen, $C_1$-$C_4$ alkyl, $C_1$-$C_4$ hydroxyalkyl, or $—(C_2H_4O)_xH$, where x is from 1 to 3.

Another class of nonionic surfactants includes the class defined as alkoxylated amines or, most particularly, alcohol alkoxylated/aminated/alkoxylated surfactants. These nonionic surfactants may be at least in part represented by the general formulae: $R^{20}—(PO)_sN\text{-}(EO)_tH$, $R^{20}—(PO)_sN\text{-}(EO)_tH(EO)_tH$, and $R^{20}—N(EO)_tH$; where $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1-20, preferably 2-5, t is 1-10, preferably 2-5, and u is 1-10, preferably 2-5.

Other variations on the scope of these compounds may be represented by the alternative formula $R^{20}—(PO)_v—N[(EO)_wH][(EO)_zH]$, where $R^{20}$ is an alkyl, alkenyl or other aliphatic group, or an alkyl-aryl group of from 8 to 20, preferably 12 to 14 carbon atoms, v is 1 to 20 (e.g., 1, 2, 3, or 4 (preferably 2)), and w and z is independently 1-10, preferably 2-5.

These compounds are represented commercially by a line of products sold by Huntsman Chemicals as nonionic surfactants. A preferred chemical of this class includes SURFONIC™ PEA 25 Amine Alkoxylate.

The composition may further comprise semi-polar nonionic surfactants. Examples of semi-polar nonionic surfactants include amine oxides and water soluble phosphine oxide and sulfoxide compounds.

Amine oxides are tertiary amine oxides corresponding to the general formula:

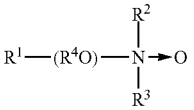

where the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants can be selected from coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl) dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants also include the water soluble phosphine oxides having the following structure:

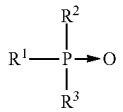

where the arrow is a conventional representation of a semi-polar bond; $R^1$ is an alkyl, alkenyl or hydroxyalkyl moiety ranging from 10 to about 24 carbon atoms in chain length; and $R^2$ and $R^3$ are each alkyl moieties separately selected from alkyl or hydroxyalkyl groups containing 1 to 3 carbon atoms. Examples of useful phosphine oxides include dimethyldecylphosphine oxide, dimethyltetradecylphosphine oxide, methylethyltetradecyl-phosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants also include the water soluble sulfoxide compounds which have the structure:

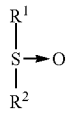

where the arrow is a conventional representation of a semi-polar bond; $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms. Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Amphoteric and Zwitterionic Surfactants.

Amphoteric and zwitterionic surfactants include derivatives of secondary and tertiary amines, derivatives of heterocyclic secondary and tertiary amines, or derivatives of quaternary ammonium, quaternary phosphonium or tertiary sulfonium compounds. The ammonium, phosphonium, or sulfonium compounds can be substituted with aliphatic substituents, e.g., alkyl, alkenyl, or hydroxyalkyl; alkylene or hydroxy alkylene; or carboxylate, sulfonate, sulfate, phosphonate, or phosphate groups. Betaine and sultaine surfactants are exemplary zwitterionic surfactants for use in the present composition.

Zwitterionic surfactants can be thought of as a subset of amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants.

A general formula for these compounds is:

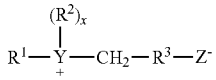

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups can be straight or branched and saturated or unsaturated.

Zwitterionic surfactants include betaines of the general structure:

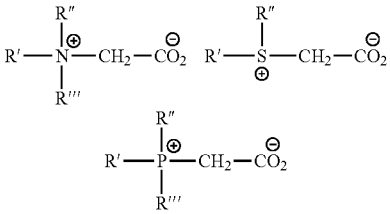

These surfactant betaines typically do not exhibit strong cationic or anionic characters at pH extremes, nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentane-diethylbetaine; and $C_{12-16}$ acylmethylamidodimethylbetaine.

Sultaines include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

Amphoteric Surfactants.

Amphoteric or ampholytic surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation, for example with ethyl acetate. During alkylation, one or two carboxy-alkyl groups react to form a tertiary amine and an ether linkage with differing alkylating agents yielding different tertiary amines.

Long chain imidazole derivatives have the general formula:

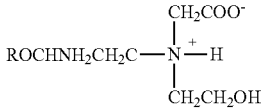

(mono)acetate

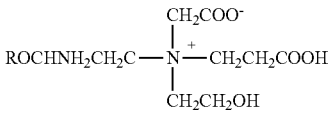

(di)propionate

-continued

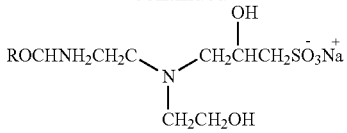

Neutral pH-Zwitterion amphoteric sulfonate wherein R is an acyclic hydrophobic group containing from 8 to 18 carbon atoms and M is a cation to neutralize the charge of the anion, generally sodium. Exemplary commercially available imidazoline-derived amphoterics include: cocoamphopropionate, cocoamphocarboxy-propionate, cocoamphoglycinate, cocoamphocarboxy-glycinate, cocoamphopropyl-sulfonate, and cocoamphocarboxy-propionic acid. Preferred amphocarboxylic acids are produced from fatty imidazolines in which the dicarboxylic acid functionality of the amphodicarboxylic acid is diacetic acid and/or dipropionic acid. The carboxymethylated compounds (glycinates) described here are frequently called betaines.

Long chain N-alkylamino acids are readily prepared by reacting $RNH_2$, in which $RisC_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename MIRANOL™ FBS from Solvay S.A. Another most preferred coconut derived amphoteric surfactant with the chemical name disodium cocoampho diacetate is sold under the tradename MIRANOL™ C2M-SF Conc., also from Solvay S.A.

The surfactants can be present at about 0.1 to about 5%, about 0.15 to about 4%, about 0.2 to about 3%, or about 0.3 to about 2.5% of a use solution of the composition. In one example, the surfactants are present at about 0.25 to about 4% of the composition. If the composition is provided as a concentrate, the surfactants can be present at about 3 to about 30%, about 5 to about 20%, or about 8 to about 15% of the composition.

Solvent

The composition is preferably provided as an aqueous solution. The composition may further include one or more additional solvents. For example, the composition may include a water-soluble organic solvent, such as such as, esters, ethers, ketones, amines, and non-aromatic solvents. Examples of suitable solvents include water soluble glycols and glycol ethers. Examples of glycols include ethylene glycol, propylene glycol, butylene glycol, and hexylene glycol. Preferred glycols include propylene glycol and hexylene glycol. Examples of glycol ethers include ethylene glycol monobutyl ether, propylene glycol methyl ether, diethylene glycol monoethyl ether, diethylene glycol monobutyl ether, diethylene glycol monohexyl ether, diethylene glycol monomethyl ether, and dipropylene glycol methyl ether, and commercially available under DOWANOL® and CARBITOL™ trade names from Dow Chemical Company, Midland, Mich. In some embodiments, the glycol serves a dual purpose, acting to solubilize the glycol ether, as well as promoting the formation of a thick, rich foam in an amphoteric surfactant-glycol ether system. In certain embodiments, the solvents are non-flammable.

The solvent can be present at about 0.1 to about 5%, about 0.3 to about 4%, or about 0.5 to about 2% of a use solution of the composition. In one example, the solvent is present at about 0.2 to about 0.8% of a use solution of the composition. If the composition is provided as a concentrate, the solvent can be present at about 1 to about 25%, about 2 to about 20%, about 4 to about 16%, or about 5 to about 10% of the composition. In one example, the composition is a concentrate that includes about 25 to about 90% water, about 4 to about 10% glycol ether and about 4 to about 10% glycol.

In formulations that include high levels of dicarboxylate, a hydrotrope (e.g., a surfactant and/or co-solvent) can be included to keep the solvent in solution. The composition may contain one or more co-solvents selected from monohydric or polyhydric alcohols, in particular from ethanol, n-propanol or i-propanol, butanol, glycol, propanediol, butanediol, glycerol, diglycol, propyldiglycol, butyldiglycol, and mixtures thereof. In some embodiments, the co-solvent is a glycol, such as a propylene glycol or hexylene glycol.

The co-solvent can be present at about 0.1 to about 5%, about 0.3 to about 4%, or about 0.5 to about 2% of a use solution of the composition. In one example, the co-solvent is present at about 0.2 to about 0.8% of a use solution of the composition. If the composition is provided as a concentrate, the co-solvent can be present at about 1 to about 25%, about 2 to about 20%, about 4 to about 16%, or about 5 to about 10% of the composition. In one example, the composition includes about 4 to about 10% propylene glycol or hexylene glycol.

According to some aspects of the present disclosure, the composition includes dicarboxylic acids (e.g., malonic acid, succinic acid, glutaric acid, adipic acid, or a combination thereof), one or more amphoteric surfactants (e.g., amines), one or more glycol ethers, and optionally a co-solvent (e.g., propylene or hexylene glycol), that together provide a synergistic effect of improved cleaning efficacy. The components may also act synergistically to provide improved foaming and cleaning efficacy.

Antimicrobial Agent

The composition may also include an antimicrobial or biocidal agent. Suitable antimicrobial agents are those that are effective in alkaline solutions. Examples of suitable antimicrobial agents include quaternary ammonium compounds and tertiary ammonium compounds. An example of a commercially available tertiary ammonium compound is LONZABAC® 12, available from Lonza Inc. in Allendale, N.J.

pH Modifiers

While the composition may include one or more acids, the composition may further include other pH modifiers that adjust the pH of the use solution when the composition is dissolved. Alternatively, the pH modifiers (including the one or more acids) can be dosed as separate components into the use solution. The pH of the use solution may be adjusted to provide optimal de-staining and/or detersive activity, and may be optimized based on various factors, such as water hardness and other components included in the composition. For example, the pH of the use solution may be from about 7 to about 13, from about 8 to about 12, from about 9 to about 11, or from about 9.5 to about 10.5. In an embodiment, the pH of the use solution is basic (i.e., above 7). In one embodiment, the pH of the use solution is about 10, from about 10 to about 10.5, or from about 10 to about 11. Suitable pH modifiers include bases and acids, such as alkali metal hydroxides (e.g., sodium hydroxide or potassium hydroxide), organic and inorganic acids.

According to an embodiment, the composition comprises a dicarboxylic acid or its salt, one or more surfactants, and optional solvents and co-solvents. The composition has a pH in the range of 7-12.5, or preferably from about 9 to about 11. A concentrate composition may comprise dicarboxylic acid or its salt at about 3 to about 25%, about 4 to about 20%, or about 5 to about 15%; surfactants at about 3 to about 30%, about 5 to about 20%, or about 8 to about 15%; optionally solvents at about 1 to about 25%, about 2 to about 20%, about 4 to about 16%, or about 5 to about 10%; optionally co-solvents at about 1 to about 25%, about 2 to about 20%, about 4 to about 16%, or about 5 to about 10% of the composition; and optionally pH adjusting agents (e.g., sodium hydroxide). The balance of the concentrate composition can be water. In one example, the concentrate composition includes about 4 to about 20% of a dicarboxylic acid selected from malonic acid, succinic acid, glutaric acid, adipic acid, and combinations thereof; about 5 to about 20% of surfactants; about 2 to about 10% solvent (e.g., glycol ether); about 2 to about 10% co-solvent (e.g., glycol); and about 25 to about 87% water, and optionally a pH adjusting agent (e.g., sodium hydroxide). The composition may also include additional agents, such as antimicrobials, fragrances, dyes, rheology modifiers, foaming agents, antifoaming agents, etc.

Alternatively, the composition can be provided as a ready-to-use solution. A ready-to-use solution may comprise dicarboxylic acid or its salt at about 0.1 to about 5%, about 0.15 to about 4%, about 0.2 to about 3%, or about 0.3 to about 2.5%; surfactants at about 0.1 to about 5%, about 0.15 to about 4%, about 0.2 to about 3%, or about 0.3 to about 2.5%; optionally solvent at about 0.1 to about 5%, about 0.3 to about 4%, or about 0.5 to about 2%; optionally co-solvent at about 0.1 to about 5%, about 0.3 to about 4%, or about 0.5 to about 2%; and optionally pH adjusting agents (e.g., sodium hydroxide). The balance of the ready-to-use composition can be water. In one example, the ready-to-use solution has a pH of about 9 to about 11 and includes about 0.25 to about 4% dicarboxylic acid selected from malonic acid, succinic acid, glutaric acid, adipic acid, and combinations thereof; about 0.2 to about 0.8% solvent (e.g., glycol ether); about 0.2 to about 0.8% co-solvent (e.g., glycol), optionally a pH adjusting agent (e.g., sodium hydroxide), and balance water. The composition may also include additional agents, such as antimicrobials, fragrances, dyes, rheology modifiers, foaming agents, antifoaming agents, etc.

The composition is formulated to minimize damage to calcite-based stone surfaces, in particular marble surfaces. However, the composition is an effective hard surface cleaner and can be used on any other hard surfaces that are generally compatible with the components and pH of the composition. The composition can be formulated to have a pH that is suitable for use without personal protective equipment ("PPE") and is minimally damaging to common hard surfaces. For example, the composition can have a pH of about 9.5 to about 10.5. The composition can also be formulated to be free of strong irritants, such as commonly known irritating solvents, surfactants, or other components.

The composition can be used in the same manner as conventional hard-surface cleaners. For example, the composition can be applied to a surface by wiping, squirting, spraying, pouring, dripping, sponging, or by any other suitable method. The composition can be rinsed or wiped off, or can be allowed to dwell on the surface for a suitable length of time before the composition is removed. For example, the composition can be allowed to remain on the surface for a few seconds, or from about 0 seconds to about 2 minutes or even longer. In one example, the composition is applied to a marble surface and is allowed to remain on the surface for about 30 seconds, about 1 minute, about 2 minutes, about 3 minutes, about 4 minutes, about 5 minutes, or about 1 to about 10 minutes. After the dwell time the surface can be wiped and/or scrubbed. The composition can be rinsed or wiped off the surface without causing any damage to the marble surface. Alternatively the composition can be used without rinsing.

EXAMPLES

Various exemplary compositions were prepared and tested using a lime soap soil cleaning procedure. In the procedure, lime soap soil formulated based on samples found on hotel showers is applied to glass slides to simulate a non-porous bathroom surface. The soil is cleaned by spraying the cleaning composition onto the soiled slide, allowing the cleaning composition to dwell for 30 seconds, and wiping/scrubbing the slide with a cleaning sponge. The sponge cleaning action is automated so that the test can be reliably replicated. After cleaning, the slide is rinsed with DI water and allowed to dry. The cleaning effect is measured by weighing the slide before and after to calculate the loss of soil.

The commercially available neutral cleaner used as a comparative example was Neutral Bathroom Cleaner available from Ecolab Inc. The commercially available marble safe cleaner was Oasis Pro 70 Marble Safe Cleaner, also available from Ecolab Inc.

Example 1

Formulas A1, A2, and A3 were prepared and tested for their cleaning efficacy along with a commercially available neutral cleaner using the lime soap cleaning procedure. The formulations are shown in TABLE 1A below.

TABLE 1A

Exemplary cleaning formulations.

| | A1 (%) | A2 (%) | A3 (%) |
|---|---|---|---|
| Water Deionized | 55.40 | 36.75 | 30.25 |
| Succinic Acid | 12.00 | 0.00 | 7.50 |
| MEA | 8.40 | 5.25 | 5.25 |
| NaOH (50%) | 15.20 | 0.00 | 10.00 |
| Nonionic surfactant (C12-6 dimethylamine oxide) | 5.00 | 9.00 | 9.00 |
| Nonionic surfactant (octyl dimethylamine oxide) | 2.00 | 4.00 | 10.00 |

TABLE 1A-continued

Exemplary cleaning formulations.

| | A1 (%) | A2 (%) | A3 (%) |
|---|---|---|---|
| Propylene Glycol | 2.00 | 5.00 | 10.00 |
| Glycol ether (butyl ether) | 0.00 | 40.00 | 18.00 |
| | 100.00 | 100.00 | 100.00 |

The loss of soil on each slide was measured and the results of three replicates were averaged. The results are shown in TABLE 1B and FIG. 1.

TABLE 1B

Cleaning Results.

| | Dilution Rate | Weight Loss (mg) |
|---|---|---|
| Commercially Available Neutral Cleaner | 4 oz/gal | 5.73 |
| | 8 oz/gal | 6.17 |
| | 16 oz/gal | 6.43 |
| A1 | 4 oz/gal | 5.77 |
| | 8 oz/gal | 6.20 |
| | 16 oz/gal | 6.33 |
| A2 | 4 oz/gal | 5.87 |
| | 8 oz/gal | 6.00 |
| | 16 oz/gal | 6.23 |
| A3 | 4 oz/gal | 6.07 |
| | 8 oz/gal | 6.50 |
| | 16 oz/gal | 7.07 |

It was observed that composition A1, which included dicarboxylic acid (succinic acid), produced similar cleaning results to the commercially available, citrate based neutral cleaner. Composition A2, which included butyl carbitol but no succinate, was also capable of some cleaning. The best cleaning effect was achieved by composition A3, which included both dicarboxylic acid (succinic acid) and solvent (butyl carbitol).

Example 2

Figure 2:
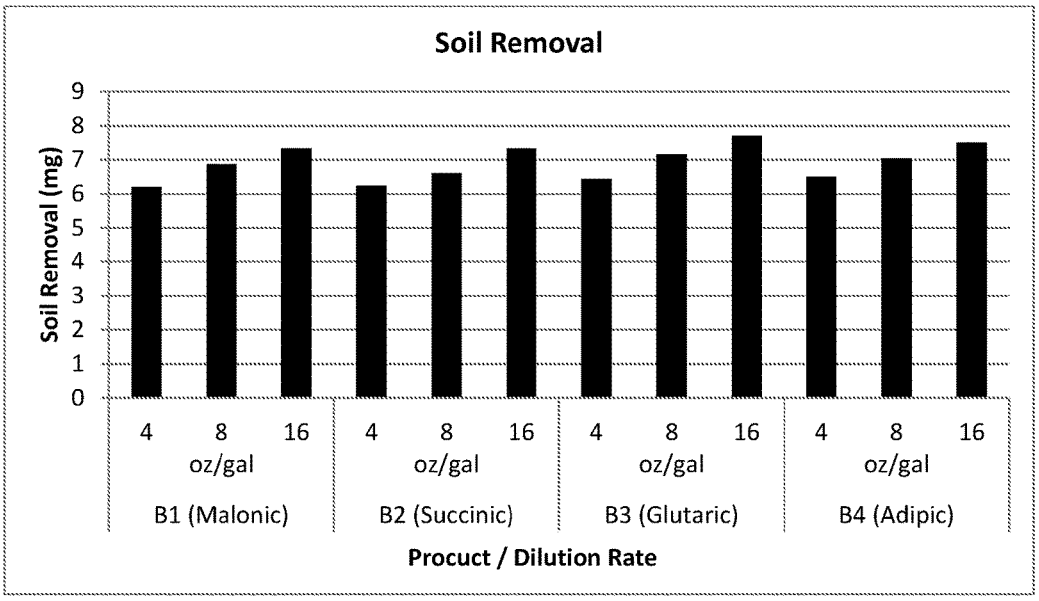
FIG. 2 is a graphical presentation of the results of Example 2.

Formulations B1, B2, B3, and B4 were prepared with malonic acid, succinic acid, glutaric acid, and adipic acid, respectively. The formulations are shown in TABLE 2A. The cleaning efficacy of the formulations was tested at three dilution levels (4, 8, and 16 oz/gal), in triplicate, using the lime soap cleaning procedure. The results are shown in TABLE 2B and FIG. 2.

TABLE 2A

Cleaning Formulas with Different Dicarboxylic Acids.

| | B1 (%) | B2 (%) | B3 (%) | B4 (%) |
|---|---|---|---|---|
| Water Deionized | 34.14 | 33.25 | 32.36 | 31.47 |
| Malonic Acid | 6.61 | | | |
| Succinic Acid | | 7.50 | | |
| Glutaric Acid | | | 8.39 | |
| Adipic Acid | | | | 9.28 |
| MEA | 5.25 | 5.25 | 5.25 | 5.25 |
| NaOH (50%) | 10.00 | 10.00 | 10.00 | 10.00 |
| Nonionic surfactant (C12-6 dimethylamine oxide) | 9.00 | 9.00 | 9.00 | 9.00 |
| Nonionic surfactant (octyl dimethylamine oxide) | 10.00 | 10.00 | 10.00 | 10.00 |
| Propylene Glycol | 8.00 | 8.00 | 8.00 | 8.00 |

TABLE 2A-continued

| Cleaning Formulas with Different Dicarboxylic Acids. | | | | |
|---|---|---|---|---|
| | B1 (%) | B2 (%) | B3 (%) | B4 (%) |
| Glycol ether (butyl ether) | 15.00 | 15.00 | 15.00 | 15.00 |
| Antimicrobial (biocidal amine) | 2.00 | 2.00 | 2.00 | 2.00 |
| | 100.00 | 100.00 | 100.00 | 100.00 |

TABLE 2B

| Cleaning Results for Formulas B1, B2, B3, and B4. | | | | |
|---|---|---|---|---|
| | | Wt. Loss (mg) | Average (mg) | StDev |
| B1 | 4 oz/gal | 6.3 | 6.20 | 0.1000 |
| | | 6.2 | | |
| | | 6.1 | | |
| | 8 oz/gal | 7 | 6.87 | 0.1155 |
| | | 6.8 | | |
| | | 6.8 | | |
| | 16 oz/gal | 7.7 | 7.33 | 0.3215 |
| | | 7.2 | | |
| | | 7.1 | | |
| B2 | 4 oz/gal | 6.4 | 6.23 | 0.2082 |
| | | 6 | | |
| | | 6.3 | | |
| | 8 oz/gal | 6.6 | 6.60 | 0.2000 |
| | | 6.8 | | |
| | | 6.4 | | |
| | 16 oz/gal | 7.6 | 7.33 | 0.2309 |
| | | 7.2 | | |
| | | 7.2 | | |
| B3 | 4 oz/gal | 6.3 | 6.43 | 0.1528 |
| | | 6.4 | | |
| | | 6.6 | | |
| | 8 oz/gal | 7.4 | 7.17 | 0.2517 |
| | | 7.2 | | |
| | | 6.9 | | |
| | 16 oz/gal | 7.8 | 7.70 | 0.2646 |
| | | 7.9 | | |
| | | 7.4 | | |
| B4 | 4 oz/gal | 6.4 | 6.50 | 0.1000 |
| | | 6.6 | | |
| | | 6.5 | | |
| | 8 oz/gal | 7.1 | 7.03 | 0.0577 |
| | | 7 | | |
| | | 7 | | |
| | 16 oz/gal | 7.5 | 7.50 | 0.1000 |
| | | 7.4 | | |
| | | 7.6 | | |

It was observed that the compositions with malonic, glutaric, and adipic acid provide a cleaning efficacy that is comparable to succinic acid.

Example 3

Figure 3:
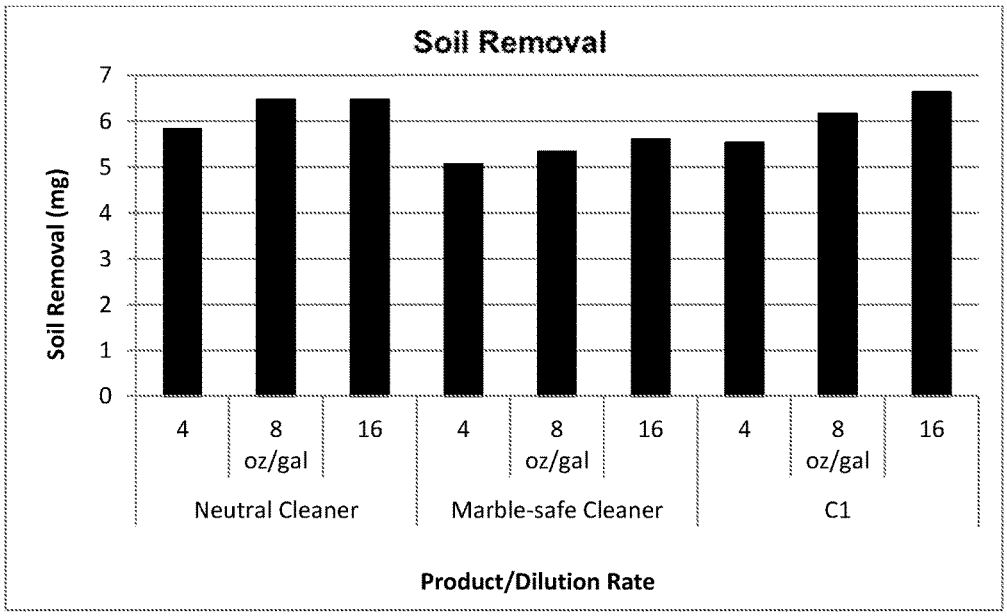
FIG. 3 is a graphical presentation of the results of Example 3.

An exemplary formula C1 (PA7a) was prepared and tested against a commercially available neutral bathroom cleaning solution and a commercially available marble-safe cleaner. The commercially available neutral cleaner provides good cleaning efficacy, but is known to damage marble surfaces over time. On the other hand, the commercially available marble-safe cleaner is safe on marble surfaces, but does not provide adequate cleaning of lime soil. The results are shown in TABLE 3B and FIG. 3

TABLE 3A

| Formula C1. | |
|---|---|
| | Amount (%) |
| Water (deionized) | 30.75 |
| Succinic Acid | 7.50 |
| MEA | 5.25 |
| NaOH (50%) | 9.50 |
| Nonionic surfactant (C12-6 dimethylamine oxide) | 9.00 |
| Nonionic surfactant (octyl dimethylamine oxide) | 10.00 |
| Propylene Glycol | 10.00 |
| Glycol ether (butyl ether) | 18.00 |
| TOTAL | 100.00 |

TABLE 3B

| Cleaning Results for Formula C1. | | |
|---|---|---|
| | Dilution Rate | Weight Loss (mg) |
| Commercially Available Neutral Cleaner | 4 oz/gal | 5.83 |
| | 8 oz/gal | 6.47 |
| | 16 oz/gal | 6.47 |
| Commercially Available Marble-Safe Cleaner | 4 oz/gal | 5.07 |
| | 8 oz/gal | 5.33 |
| | 16 oz/gal | 5.60 |
| C1 | 4 oz/gal | 5.53 |
| | 8 oz/gal | 6.17 |
| | 16 oz/gal | 6.63 |

Example 4

Compatibility of the commercially available neutral cleaner and marble-safe cleaner, and formulations D1, B1, B2, and B3 were tested on a marble surface. The products were diluted to 8 oz/gallon, applied to marble tiles, and allowed to dwell for two hours and 24 hours. After the dwell time, the product was rinsed away and the surface was visually examined for damage.

TABLE 4A

| Formulations B1, B2, B3, and D1. | | | | |
|---|---|---|---|---|
| | B1 (%) | B2 (%) | B3 (%) | D1 (%) |
| Water Deionized | 34.14 | 33.25 | 32.36 | 29.25 |
| Malonic Acid | 6.61 | | | |
| Succinic Acid | | 7.50 | | 7.50 |
| Glutaric Acid | | | 8.39 | |
| MEA | 5.25 | 5.25 | 5.25 | 5.25 |
| NaOH (50%) | 10.00 | 10.00 | 10.00 | 9.00 |
| Nonionic surfactant (C12-6 dimethylamine oxide) | 9.00 | 9.00 | 9.00 | 9.00 |
| Nonionic surfactant (octyl dimethylamine oxide) | 10.00 | 10.00 | 10.00 | 10.00 |
| Propylene Glycol | 8.00 | 8.00 | 8.00 | 10.00 |
| Glycol ether (butyl ether) | 15.00 | 15.00 | 15.00 | 18.00 |
| Antimicrobial (biocidal amine) | 2.00 | 2.00 | 2.00 | 2.00 |
| | 100.00 | 100.00 | 100.00 | 100.00 |

TABLE 4B

| Marble Compatibility. | | |
|---|---|---|
| | 2 hours | 24 hours |
| Commercially available neutral cleaner | Moderate Damage | Moderate Damage |
| Commercially available marble-safe cleaner | No Damage | No Damage |
| D1 | No Damage | No Damage |
| B1 | No Damage | No Damage |
| B2 | No Damage | No Damage |
| B3 | No Damage | No Damage |

It was observed that the commercially available neutral cleaner had visually dulled the marble tile, while the rest of the products had no effect on the tile's surface.

While certain embodiments of the invention have been described, other embodiments may exist. While the specification includes a detailed description, the invention's scope is indicated by the following claims. The specific features and acts described above are disclosed as illustrative aspects and embodiments of the invention. Various other aspects, embodiments, modifications, and equivalents thereof which, after reading the description herein, may suggest themselves to one of ordinary skill in the art without departing from the spirit of the present invention or the scope of the claimed subject matter.

What is claimed is:

1. A method for cleaning a calcite stone surface, the method comprising:

(a) preparing a use solution by diluting a composition with water, wherein the composition comprises:
from 3 to 20 wt-% dicarboxylic acid,
from 3 to 25 wt-% surfactant,
from 0 to 20 wt-% solvent, and
a glycol co-solvent;

(b) applying the use solution to the calcite stone surface; and (c) rinsing, wiping, or scrubbing the surface.

2. The method of claim 1, wherein the use solution does not damage the calcite stone surface.

3. The method of claim 1, wherein the use solution of the composition has a pH of 8 to 12.5.

4. The method of claim 3, wherein the use solution of the composition has a pH of 9.5 to 11.

5. The method of claim 1, wherein the dicarboxylic acid comprises acids having a carbon chain length of 2 to 8.

6. The method of claim 5, wherein the dicarboxylic acid comprises acids having a carbon chain length of 3 to 6.

7. The method of claim 1, wherein the dicarboxylic acid is selected from malonic acid, succinic acid, glutaric acid, adipic acid, and combinations thereof.

8. The method of claim 1, wherein the composition is free of dicarboxylic acids having other functional groups.

9. The method of claim 1, wherein the solvent comprises one or more glycol ethers.

10. The method of claim 1, wherein the solvent is selected from glycol ethers.

11. The method of claim 9, wherein the glycol ethers comprise ethylene glycol monobutyl ether, propylene glycol methyl ether, diethylene glycol monoethyl ether, diethylene glycol monobutyl ether, diethylene glycol monohexyl ether, diethylene glycol monomethyl ether, and dipropylene glycol methyl ether.

12. The method of claim 1, wherein the glycol is selected from the group consisting of ethylene glycol, propylene glycol, butylene glycol, and hexylene glycol.

13. The method of claim 1, wherein the composition is diluted with water at a dilution ratio of composition to water of from about 1:2 to about 1:100.

14. A method for cleaning a calcite stone surface, the method comprising:

(a) applying a use solution composition to the calcite stone surface, the use solution composition comprising:
from 0.1 to 5 wt-% dicarboxylic acid,
from 0.1 to 5 wt-% surfactant,
from 0 to 5 wt-% solvent, and
a glycol co-solvent; and (b) rinsing, wiping, or scrubbing the surface.

15. The method of claim 14, wherein the use solution does not damage the calcite stone surface.

16. The method of claim 14, wherein the use solution of the composition has a pH of 9.5 to 11.

17. The method of claim 14, wherein the dicarboxylic acid comprises acids having a carbon chain length of 3 to 6.

18. The method of claim 14, wherein the dicarboxylic acid is selected from malonic acid, succinic acid, glutaric acid, adipic acid, and combinations thereof.

19. The method of claim 14, wherein the composition is free of dicarboxylic acids having other functional groups.

20. The method of claim 14, wherein the solvent comprises one or more glycol ethers.

21. The method of claim 20, wherein the glycol ethers comprise ethylene glycol monobutyl ether, propylene glycol methyl ether, diethylene glycol monoethyl ether, diethylene glycol monobutyl ether, diethylene glycol monohexyl ether, diethylene glycol monomethyl ether, and dipropylene glycol methyl ether.

22. The method of claim 14, wherein the glycol is selected from the group consisting of ethylene glycol, propylene glycol, butylene glycol, hexylene glycol, or a combination thereof.

23. A composition comprising:
from 3 to 20 wt-% dicarboxylic acid;
from 3 to 25 wt-% surfactant;
from 0 to 20 wt-% solvent;
a glycol co-solvent; and
water,
wherein the composition has a pH from 9 to 12.5, and the composition is safe for use with calcite stone surfaces.

24. The composition of claim 23, wherein the use solution of the composition has a pH from 9.5 to 11.

25. The composition of claim 23, wherein the dicarboxylic acid comprises acids having a carbon chain length of 2 to 8.

26. The composition of claim 25, wherein the dicarboxylic acid comprises acids having a carbon chain length of 3 to 6.

27. The composition of claim 23, wherein the dicarboxylic acid is selected from malonic acid, succinic acid, glutaric acid, adipic acid, and combinations thereof.

28. The composition of claim 23, wherein the composition is free of dicarboxylic acids having other functional groups.

29. The composition of claim 23, further comprising an antimicrobial agent.

30. The composition of claim 23, wherein the composition is a foam or a foaming composition.

31. A composition comprising:

from 0.1 to 5 wt-% dicarboxylic acid;

from 0.1 to 5 wt-% surfactant;

from 0 to 5 wt-% solvent a glycol co-solvent; and water, wherein the composition is a ready-to-use solution having a pH from 9 to 12.5, and the composition is safe for use with calcite stone surfaces.

32. The composition of claim 31, wherein the use solution of the composition has a pH from 9.5 to 11.

33. The composition of claim 31, wherein the dicarboxylic acid comprises acids having a carbon chain length of 2 to 8.

34. The composition of claim 33, wherein the dicarboxylic acid comprises acids having a carbon chain length of 3 to 6.

35. The composition of claim 31, wherein the dicarboxylic acid is selected from malonic acid, succinic acid, glutaric acid, adipic acid, and combinations thereof.

36. The composition of claim 31, wherein the composition is free of dicarboxylic acids having other functional groups.

37. The composition of claim 31, further comprising an antimicrobial agent.

38. The composition of claim 31, wherein the composition is a foam or a foaming composition.

* * * * *